US007124913B2

(12) United States Patent
Birtcher et al.

(10) Patent No.: US 7,124,913 B2
(45) Date of Patent: Oct. 24, 2006

(54) HIGH PURITY CHEMICAL CONTAINER WITH DIPTUBE AND LEVEL SENSOR TERMINATING IN LOWEST MOST POINT OF CONCAVE FLOOR

(75) Inventors: Charles Michael Birtcher, Valley Center, CA (US); Gildardo Vivanco, San Diego, CA (US); Thomas Andrew Steidl, Escondido, CA (US); Richard J. Dunning, Fallbrook, CA (US)

(73) Assignee: Air Products and Chemicals, Inc., Allentown, PA (US)

( * ) Notice: Subject to any disclaimer, the term of this patent is extended or adjusted under 35 U.S.C. 154(b) by 358 days.

(21) Appl. No.: 10/602,329

(22) Filed: Jun. 24, 2003

(65) Prior Publication Data

US 2004/0262327 A1 Dec. 30, 2004

(51) Int. Cl.
*B67D 5/08* (2006.01)

(52) U.S. Cl. ..... 222/64; 222/61; 222/394; 222/399; 222/464.1; 222/464.7; 141/94; 141/198

(58) Field of Classification Search ..... 222/64, 222/66, 394, 399, 464.1, 61, 464.7; 141/94–95, 141/197–198; 137/386; 73/308, 311, 313
See application file for complete search history.

(56) References Cited

U.S. PATENT DOCUMENTS

| | | | | |
|---|---|---|---|---|
| 4,440,319 A | | 4/1984 | Nitchman et al. | 222/183 |
| 4,531,656 A | | 7/1985 | Nitchman et al. | 222/131 |
| 4,828,131 A | * | 5/1989 | Strubel | 222/464.7 |
| 4,979,545 A | * | 12/1990 | Fair | 141/83 |
| 5,038,840 A | | 8/1991 | Fair | |
| 5,069,243 A | | 12/1991 | Foreman | 137/205 |
| 5,199,603 A | | 4/1993 | Prescott | 222/3 |
| 5,562,132 A | | 10/1996 | Siegele et al. | |
| 5,568,882 A | * | 10/1996 | Takacs | 222/61 |
| 5,607,000 A | * | 3/1997 | Cripe et al. | 141/21 |
| 5,663,503 A | | 9/1997 | Dam et al. | 73/649 |
| 5,782,381 A | | 7/1998 | Woodruff et al. | 222/23 |
| 5,901,740 A | * | 5/1999 | Sanchelima | 137/392 |
| 6,077,356 A | | 6/2000 | Bouchard | |
| 6,526,824 B1 | * | 3/2003 | Chase et al. | 73/290 V |
| 6,543,493 B1 | * | 4/2003 | Jursich et al. | 141/95 |
| 6,629,627 B1 | * | 10/2003 | Siegele et al. | 222/464.1 |
| 6,792,923 B1 | * | 9/2004 | Kumagai et al. | 123/509 |
| 6,913,029 B1 | * | 7/2005 | Zorich et al. | 134/95.1 |

(Continued)

FOREIGN PATENT DOCUMENTS

DE 40 35 588 5/1992

(Continued)

*Primary Examiner*—Frederick C. Nicolas
(74) *Attorney, Agent, or Firm*—Geoffrey L. Chase

(57) ABSTRACT

A transportable container for high purity, high cost, liquid chemicals capable of maximizing dispensing of the liquid chemical content of the container at deviations from an upright position, comprising; a top wall, a side wall and a bottom wall, the bottom wall having an internal surface contacting liquid chemical with a concave upward contour having a lowest most point axially central to the container, an inlet, an outlet comprising a diptube through which the liquid chemical can be dispensed from said container with an outlet end adjacent the top surface and an inlet terminal end adjacent the lowest most point, a level sensor assembly having an output end adjacent the top surface and a terminal end adjacent the lowest most point; the diptube and the level sensor assembly being more proximate to one another at their terminal ends than their ends adjacent the top surface.

13 Claims, 4 Drawing Sheets

U.S. PATENT DOCUMENTS

2002/0108670 A1 8/2002 Baker et al.

FOREIGN PATENT DOCUMENTS

| | | |
|---|---|---|
| EP | 0 297 372 | 6/1988 |
| EP | 1 166 900 | 1/2002 |
| GB | 847354 | 9/1960 |
| WO | WO 01/42539 | 6/2001 |

* cited by examiner

HIGH PURITY CHEMICAL CONTAINER WITH DIPTUBE AND LEVEL SENSOR TERMINATING IN LOWEST MOST POINT OF CONCAVE FLOOR

BACKGROUND OF THE INVENTION

The electronic device fabrication industry requires various liquid chemicals as raw materials or precursors to fabricate integrated circuits and other electronic devices. This need arises from the requirement to dope semiconductors with various chemicals to provide the appropriate electrical properties in the semiconductor for transistors and gate oxides, as well as circuits requiring various metals, barrier layers, vias. Additionally, dielectric layers are needed for capacitors and interlayer dielectric requirements. Fabrication requiring subtractive technologies require resists, planarization chemistries and etchants.

All of the chemicals that are used in these applications are required in high purity conditions to meet the stringent requirements of the electronic fabrication industry imposed by the extremely fine line width and high device densities in current and future electronic devices being fabricated with those chemicals.

A part of the effort to provide high purity chemicals is the design and structure of the containers and systems which delivery such chemicals to the reactor or furnaces where the electronic devices are being fabricated. The purity of the chemicals can be no better than the containers in which they are stored and the systems through which they are dispensed.

In addition, it is important to monitor the quantity of high purity chemical available during its use in the electronic device fabrication process. Electronic devices are fabricated in quantities of several hundred at a time per semiconductor wafer, with the size of individual wafers being processed expected to be larger in future fabrication processes. This makes the value of the yield of electronic devices being processed on wafers very high, resulting in considerable cost if processing or fabrication occurs when the high purity chemical is unavailable inadvertently. Thus, the electronic fabrication industry has used monitoring of high purity chemical quantity a part of their scheme in their fabrication processes.

Not infrequently, the high purity chemicals used in the electronic device fabrication process also are very expensive due to their exotic or complex makeup, the low volumes need in fabrication (i.e., dopants are needed in only low levels) and the requirement for very tight product specifications (i.e., high purity and the absence of a wide array of contaminants particularly metals). As a result of the high expense of these high purity chemicals, it is desired to consume as much of the chemical as possible with out running dry. Thus residual chemical in chemical containers, i.e., heals, is desired to be minimized, but complete consumption is also not desired because in automated fabrication processing, such as electronic device fabrication, operating to a run dry condition can result in wafer defects or reduction in yields, which are unacceptable to industry and also very costly.

To address the issues of purity and monitoring of chemical quantity available for use, the industry has made various attempts to achieve those goals.

U.S. Pat. No. 5,199,603 discloses a container for organometallic compounds used in deposition systems wherein the container has inlet and outlet valves and a diptube for liquid chemical dispensing through the outlet. However, no level sensor is provided.

U.S. Pat. No. 5,562,132 describes a container for high purity chemicals with diptube outlet and internal float level sensor. The diptube is connected to the integral outlet valve. However, internal float level sensors are known particle generators for the high purity chemicals contained in the container.

U.S. Pat. No. 4,440,319 shows a container for beverages in which a diptube allows liquid dispensing based upon a pressurizing gas. The diptube may reside in a well to allow complete dispensing of the beverage. Level sense is not.

U.S. Pat. No. 5,663,503 describes an ultrasonic sensor, which is known to be used to detect liquid presence in a vessel. Invasive and non-invasive sensors are described.

U.S. Pat. No. 6,077,356 shows a reagent supply vessel for chemical vapor deposition, which vessel has a sump cavity in which the liquid discharge dip tube terminates, as well as a liquid level sensor terminates. Ultrasonic sensors are contemplated (col. 6, line 37), but in that embodiment, the patent expressly teaches that the sensor does not utilize the sump for sensing operations (col. 6, line 38–43). Good chemical utilization occurs only when the vessel is in the full upright position.

U.S. Pat. No. 4,531,656 shows a container with a rounded floor and a diptube 81.

U.S. Pat. No. 5,069,243 shows a sewage tank with a suction pipe 5 and a level sensing device 8.

U.S. Pat. No. 5,782,381 shows a container for herbicides with a discharge tube 19 and a sight tube 13.

The shortcomings of the prior art in addressing the goals of purity and efficient chemical utilization are overcome by the present invention, which provides high purity containment, no chemical entrapment areas (i.e. sump, sidewall to bottom and top transition points) to harbor residual chemical during the container empty clean and refill procedure, a symmetrical design feature enabling cost effective manufacturing and polishing to the mirror finishes (10Ra) required for high purity chemical containers to maintain chemical purity, at the low and empty level sense points where the level precision is most important the smaller cross sectional area of the container concave section enables a more precise measurement of liquid and avoidance of contamination or particle generation during level sensing, and efficient chemical utilization approaching complete chemical utilization without reaching chemical run dry conditions. Other advantages of the present invention are also detailed below.

BRIEF SUMMARY OF THE INVENTION

The present invention is a transportable container for high purity, high cost, liquid chemicals capable of maximizing dispensing of the liquid chemical content of the container at deviations from an upright position without dispensing all of the liquid chemical, comprising; a shell comprising a top wall, a side wall and a bottom wall, the bottom wall having an internal surface contacting liquid chemical with a concave upward contour having a lowest most point axially central to the container, a first orifice capable of being used as an inlet, a second orifice capable of being used as an outlet comprising a diptube through which the liquid chemical can be dispensed from said container with an outlet end adjacent the top surface and an inlet terminal end adjacent the lowest most point, a level sensor assembly capable of signaling at least one level of liquid chemical in the container having an output end adjacent the top surface and a terminal end containing a lowest most level sensing sensor adjacent the lowest most point; the diptube and the level sensor assembly being more proximate to one another at their terminal ends than their ends adjacent the top surface.

Preferably, the sidewall has a cylindrical shape.

Preferably, the level sensor assembly is located axially central to said sidewall with the diptube angled toward the lower terminal end of the level sensor assembly.

Alternatively, the diptube is located axially central to said sidewall with the level sensor assembly angled toward the lower terminal end of the diptube.

DETAILED DESCRIPTION OF THE INVENTION

Figure 1:
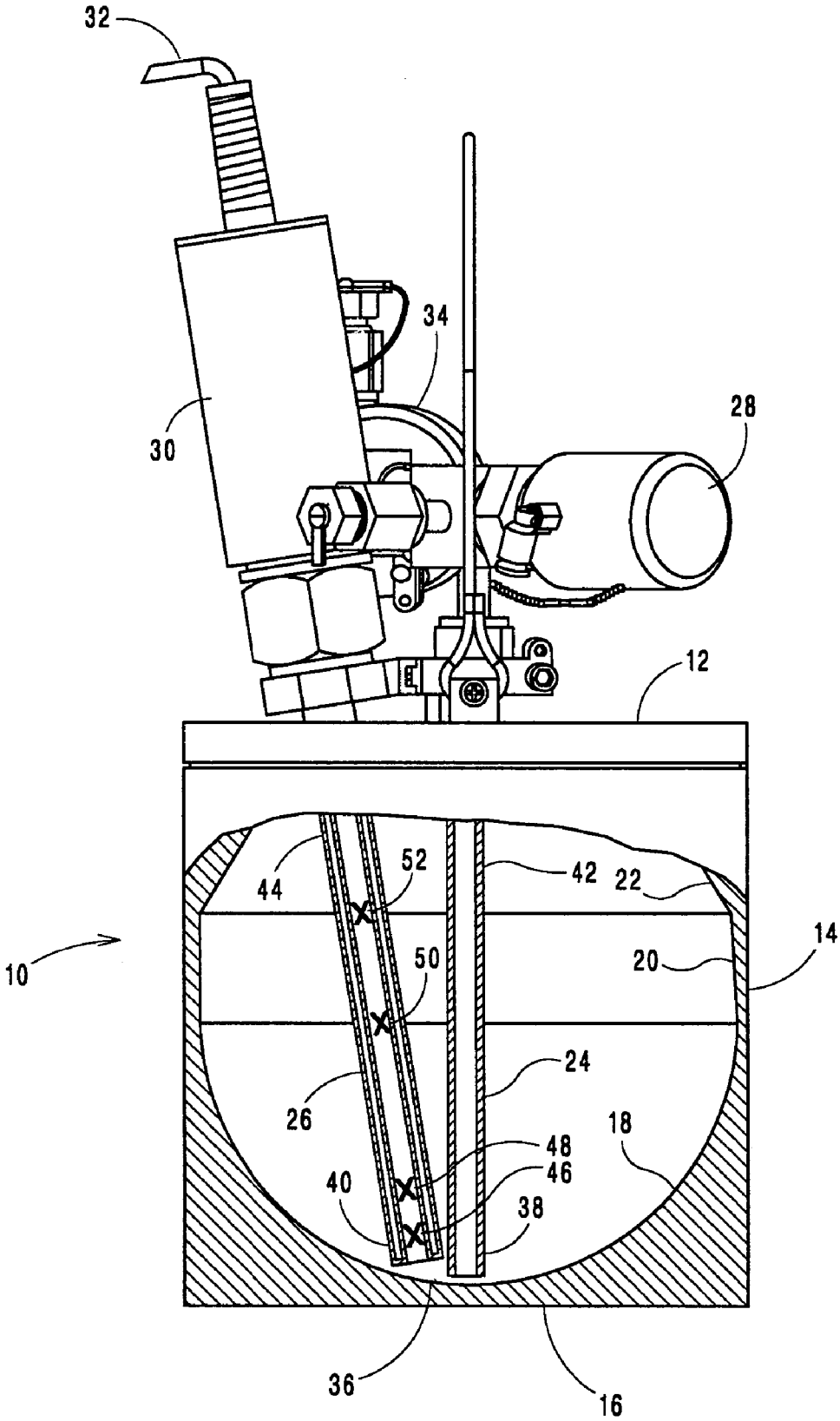
FIG. 1 is a schematic plan view of a 1.8 L container outfitted in accordance with one embodiment of the present invention in partial cross section.

The present invention is directed to a container for high purity, high cost chemical, such as is required in fabrication of semiconductor devices, flat panel displays and electronic devices. Such fabrication typically requires high purity raw materials or chemical precursors. High purity in this context typically is above 99.9 wt. %, frequently at least 99.999 wt. % and most recently at least 99.9999 wt. % pure. To maintain such purity in containers of high purity chemicals, such as liquid chemicals of the class of tetraethylorthosilicate (TEOS), containers must be designed for exacting purity and inertness. Several parameters are appropriate, including elecropolished internal surfaces of high purity chemical wetted surfaces, smooth internal surfaces both at the side walls and floor of the container which typically contact the chemical but also the top or ceiling of the container which may be difficult to clean during refurbishment due to welded top construction, inert materials of construction, such as stainless steel (316L) or quartz (depending on the chemical), absence of moving parts in the container, excellent inert seals, and ready accessibility of the container and its hardware during refilling and/or refurbishing.

High cost chemicals represent any chemical with sufficient cost to the user where the user would be concerned with nearly complete dispensing or use of the chemical, including the "heals" which are the residual chemical remaining in a container after traditional withdrawal is completed. Many of the chemicals used in the electronic device fabrication industry are high cost or very expensive due to their exotic or complex chemical makeup, complex synthesis, low volume production, unique utilization only by the electronic device fabrication industry and the requirement for purities higher than most other industries. Typical high cost chemicals as of the date of this application can range from $2/g up to $25/g and above.

Typically, high purity chemicals are today more frequently being delivered from on-site storage to the point of use at the furnace or tool, where they are utilized in a liquid state, to be vaporized or volatilized at the furnace or tool. This allows for greater throughput and more concise dispensing. One of the methods by which chemical is delivered from a container has been to use a diptube which is disposed in the chemical in the container. By applying a pressure to the headspace of the container above the liquid level, the chemical is then expelled through the diptube out of the container into a secondary device. Alternatively, the diptube can be used to dispense an inert carrier gas into the liquid chemical to bubble and entrain the chemical into the gas for removal through an outlet above the level of the liquid chemical, resulting in gas phase delivery from the container. Such containers are known in the industry as bubblers.

The diptube of the present invention is preferably used as an orifice for dispensing liquid state chemical. To achieve the most complete utilization of the chemical in the container, it is important that the diptube access and therefore dispense from the lowest most point of the container floor. However, in order to not exceed the content of the chemical in the container, i.e., not to dispense to the point of complete consumption or "dry" condition, it is also necessary to have a level sensor at the lowest most point of the container floor. Thus it is desirable that the container be configured so that both the diptube and the level sensor both terminate near the lowest most point of the container floor to facilitate nearly complete dispensing of chemical and to signal when the near complete dispensing of chemical occurs and to avoid dispensing until complete consumption actually occurs, i.e., running dry in the container.

A level sensor assembly having multiple discrete level sensors for differing height determinations is also contemplated by the present invention. Typically the level sensors in the assembly could be ultrasonic level sensors, capacitance level sensors, optical level sensors or float level sensors. Such sensors are well known in the industry and will not be further described here.

In the various embodiments of the present invention, the top, side and bottom surfaces of the container constitute the walls of the container. In some instances, the interface or intersecting seams of the various surfaces may be non-distinct, such as where the container has a generally spherical shape or the top and bottom surface represent a smooth curve continuation of the side surface or sidewall. However, the top wall is generally considered to be the area of the container, which is at the highest point of the container when it is in its normal service position. The bottom wall includes the lowest most point of the internal surface of the container when the container is in its normal service position. The sidewall constitutes the connection between the top wall and the bottom wall. In one preferred embodiment, the sidewall constitutes a cylinder.

For purposes of near complete utilization of chemical, the present invention has a bottom wall shape, which is generally a concave upward contour having a lowest most point axially central to the container. For instance, when the sidewall represents a cylinder with its axial line in the vertical plane, the axial central part of the bottom wall would coincide generally with the axial line of the sidewall cylinder. The concave upward contour may be a quadric surface corresponding generally to hemi-ellipsoid ($x^2/a^2+y^2/b^2+z^2/c^2=1$), a hemi-hyperboloid ($x^2/a^2-y^2/b^2-z^2/c^2=1$), a hemi-elliptic paraboloid ($x^2/a^2+y^2/b^2=z$), a hemi-parabolic cylinder, an elliptic cone ($x^2/a^2+y^2/b^2-z^2/c^2=0$) or more preferably a hemi-sphere ($x^2+y^2+z^2=r^2$). The important aspect of the bottom wall of the present invention is not whether the concave upward contour meets the geometric definitions of the above described shapes, but rather that the contour is a smooth curve, has a lowest most point near or at the axial central portion of the bottom wall and curves upward from the axial central portion of the bottom wall to meet the side wall.

The significance of the concave upward contour is that containers such as the present invention are located in various supporting surfaces by users when in a position to be used. Typically, such containers could be mounted on "tools" or equipment that actually handles and performs chemical deposition processes on silicon wafers. In such instances the container may not be in an absolute upright position or attitude. It is more important to the tool designer or the tool user that the main function of the tool in fabrication on the silicon wafer be appropriately achieved rather than be concerned about the exact positioning of the container of high purity, high cost chemical. Other sites where the container might be located also can easily place the container in a position that varies from the true upright position. These potential and actual variations in the placement of the container makes the design of the container for near complete chemical consumption more complex and difficult. In a precisely upright position or container attitude, a bottom wall with a sump, as is well known in the industry would be perceived to provide the best chemical consumption. However, when such containers with sumps are placed at an angle from precise upright conditions, i.e., the surface that the container rests upon is not precisely horizontal, then the completeness of chemical consumption is compromised and more significant, the readings of the level sensor can be incorrect and potential full chemical consumption to the point of running dry can occur, which is the worse case scenario from the perspective of electronic device fabricator users where expensive runs of wafers can be ruined due to the unavailability of chemical despite the readings of the level sensor of the container.

The containers contemplated by the present invention include containers that directly feed the furnace or tool of an electronic device fabrication furnace or tool where the chemical is actually used, sometimes referred to as an ampoule, canister or process container; and also to containers which refill such earlier described container, sometimes referred to as bulk containers. The containers can be of any practical size, including from one or more liters to five or more liters. The size of the container is not critical. The piping or valved manifolds which deliver chemical to or from the containers are well known in the industry and are not described further, but they are typically referred to as chemical delivery systems and include, in addition to piping and valved manifolds, sources of pressurized inert gas (carrier or push gas), an automated control unit, source of pneumatic air to operate pneumatic valves, vent lines, purge lines, sources of vacuum, flow control and monitoring hardware and other attendant devices, which are not the topic of the present invention.

Chemicals that can be contained in the containers of the present invention may include: tetraethylorthosilicate (TEOS), borazine, aluminum trisec-butoxide, carbon tetrachloride, trichloroethanes, chloroform, trimethylphosphite, dichloroethylenes, trimethylborate, dichloromethane, titanium n-butoxide, dialkylsilane, diethylsilane, dibutylsilane, alkylsilanehydrides, hexafluoroacetylacetonato-copper(1) trimethylvinylsilane, isopropoxide, triethylphoshate, silicon tetrachloride, tantalum ethoxide, tetrakis(diethylamido)titanium, tetrakis(dimethylamido)titanium, bis-tertiarybutylamido silane, triethylborate, titanium tetrachloride, trimethylphosphate, trimethylorthosilicate, titanium ethoxide, tetramethyl-cyclo-tetrasiloxane, titanium n-propoxide, tris(trimethylsiloxy)boron, titanium isobutoxide, tris(trimethylsilyl)phosphate, 1,1,1,5,5,5-hexafluoro-2,4-pentanedione, tetramethylsilane, 1,3,5,7-tetramethylcyclotetrasiloxane and mixtures thereof.

These chemicals are in most instances are relatively expensive and users desire to use as much of the chemical as possible without running out of chemical and shutting down the process consuming the chemicals. Electronic device fabrication uses expensive tool sets and creates expensive, value-added wafers with a large number of discrete integrated circuits per wafer. It is important to use as much of the chemical precursors as possible to save on the cost of the integrated circuit, but at the same time, it is expensive to shut the wafer processing tool sets or produce defective integrated circuits.

Therefore, it is desirable to use automatic level sensing to sense liquid chemical level to avoid complete consumption of the chemical and to facilitate container changeout or refill without effecting the quality of the downstream wafer processing which uses such chemical.

It is further desirable to locate the level sensor adjacent the lowest most point of the bottom wall of the container so that the sensor can measure very small amounts of consumable chemical for nearly complete utilization of those chemicals.

Therefore, a significant aspect of the present invention is the combination of a level sensor positioned to detect liquid level in a container ultimately detecting residual chemical at the lowest most point of the container which allows for accurate signals of chemical level in very small residual chemical volumes at differing deviations from an upright position of the container using a bottom wall contour which is defined as an concave upward contour, such as a hemisphere or the alternate smooth curving shapes recited above.

To achieve that goal, the present invention provides a container with a lowest most point in the concave upward contoured bottom wall adequate to accommodate the sensing function of the level sensor and the lower end of a diptube for withdrawing chemical from the container. The concave upward contour of the bottom wall is shaped adequately to not adversely effect the chemical consumption and the level sensing when the container is not in a precisely upright position.

The preferred level sensor is an ultrasonic level sensor, which operates by generating ultrasonic waves through the chemical in the container and reflecting a portion of the waves off the surface of the liquid chemical. The reflected ultrasonic waves are detected by the sensor and the time it takes the detection of the generated ultrasonic waves is proportional to whether the level of the liquid is at the position of the particular ultrasonic level sensor. In a preferred embodiment, the level sensing is performed with a level sensor assembly having four discrete level sensors in the tubular body of the level sensor assembly. However, it is contemplated that the container of the present invention can have one or more discrete level sensors in the level sensor assembly. Liquid chemical travels up the tubular assembly and each discrete ultrasonic level sensor is capable of detecting the presence or absence of liquid chemical at such level sensors position on the assembly.

In these described embodiments, all components are manufactured from suitable metallic and non-metallic, compatible materials. In general, depending on the chemical in the container, this can include, but is not limited to, stainless steel (electropolished 316L), nickel, chromium, copper, glass, quartz, Teflon®, hastelloy, Vespel®, alumina, Kel-F, PEEK, Kynar®, silicon carbide or any other metallic, plastic or ceramic material, and variations and combinations are contemplated.

In FIG. 1, a 1.8 liter container 10 is illustrated, with a side surface or wall 14, a bottom or bottom wall 16 having a concave upward contour comprising a hemi-spherical upward contour and a lowest most point 36 at the axial central region of the wall 16 and the side wall 14 attached to the lower or lowest most circumferential edge of side surface 14, a top or top surface 12, an inlet pneumatic valve 34 connected to an inlet orifice (not shown) typically connected to a source of inert pressurized gas (i.e., nitrogen, helium) to pressurize the headspace above the liquid level of the high purity liquid chemical to drive chemical out the diptube, an outlet orifice comprising a removable diptube 24. The diptube 24 has an outlet end 42 adjacent the top wall 12 controlled by pneumatic valve 28 and an inlet terminal end 38, which ends very near the bottom wall of the container at its lowest most point 36 at the axial central portion of the bottom wall.

The internal surface 18 of the bottom wall 16 has the hemispherical upward contour from the lowest most point 36 to the intersection with the internal surface 20 of the sidewall 14. The top wall 12 can have an internal surface 22, which is concave downward in contour such as a hemispherical downward contour, which facilitates cleaning during refurbishing of the container and during refilling, particularly when the top wall 12 is welded to the sidewall 14.

The lowest most point 36 of the bottom wall 16 is also shared by an ultrasonic level sensor assembly 26 having an output end 44 which delivers the signals from the discrete sensors 46, 48, 50 and 52 to the output device 30 having process electronics for amplifying or modulating the signal and finally to a connector 32 for connection and transmission of the sensor signal to any process controller the container may be operating with, such as any automated control an readout device desired, as are standard in the industry.

The diptube 24 is axially centrally located and the level sensor assembly 26 is angled in from a point at its output end 44 separate or spaced apart from the axial central area to an adjacent or proximate point to the axial central portion of the vessel at its terminal end 40, so that the level sensor assembly 44 and the diptube 24 share the lowest most point 36 of the bottom wall 16 for nearly complete chemical utilization and attendant sensing.

Appropriate ultrasonic level sensors are available commercially, such as the ML101 from Cosense, Inc. located at 155 Ricefield Lane, Hauppage, N.Y. 11788. The sensor signal is transmitted through its connector wire in conduit 26, up the side wall 14 of container 10 through a protective shroud 30 to cable 32 connecting to an appropriate process controller as is well known in the industry.

Figure 2:
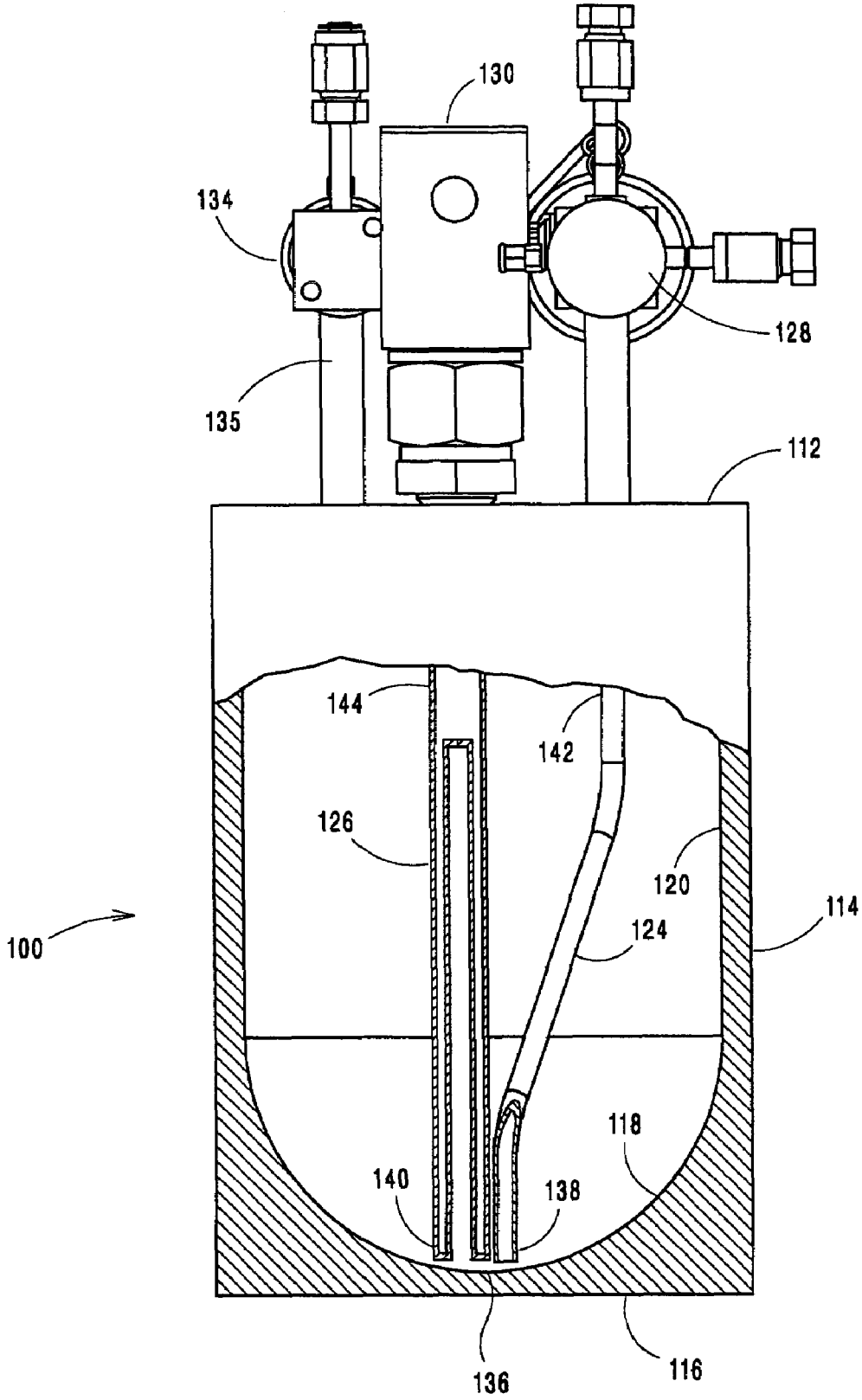
FIG. 2 is a schematic plan view of a 2.5 L container outfitted in accordance with one embodiment of the present invention in partial cross section.

In FIG. 2, a 2.5 liter container 100 is illustrated, with a side surface or wall 114, a bottom or bottom wall 116 having a hemi-spherical upward contour at its internal surface 118 and a lowest most point 136 at the axial central region of the wall 116 and the side wall 114, with an internal surface 120 forming a cylinder in relation to its cross-section parallel to the plane of the top wall 112 or the bottom wall 116, attached to the lower or lowest most circumferential edge of side surface 114, a top or top surface 112, an inlet pneumatic valve 134 connected to an inlet orifice 135 typically connected to a source of inert pressurized gas (i.e., nitrogen, helium) to pressurize the headspace above the liquid level of the high purity liquid chemical to drive chemical out the diptube, and an outlet orifice comprising a diptube 124. The diptube 124 has an outlet end 142 adjacent the top wall 112 controlled by valve 128 and an inlet terminal end 138, which ends very near the bottom wall 116 of the container 100 at its lowest most point 136 at the axial central portion of the bottom wall 116.

The diptube 124 is nearly axially centrally located only at its inlet terminal end 138 due to a bend in its length from its outlet end 142 distanced from the axial central portion of the container. The level sensor assembly 126 is axially central from its output end 144 to its terminal end 140, so that the level sensor assembly 126 and the diptube 124 share the lowest most point 136 of the bottom wall 116 for nearly complete chemical utilization and attendant sensing (the level sensor assembly would have discrete sensors as in FIG. 1, but they are not illustrated here). This arrangement of the diptube and the level sensor assembly in relation to the axial central portion of the container is reversed from the 1.8 liter container illustrated in FIG. 1, but it should be understood that for the purpose of the present invention either embodiment is appropriate and both the diptube and the level sensor assembly could be parallel to one another in an axially central position. Level sensor assembly 126 has discrete level sensors (not illustrated) similar to those shown in FIG. 1. The signals from those level sensors are delivered to output device 130 having process electronics for amplifying or modulating the signal and finally to a connector (not illustrated but similar to FIG. 1) for connection and transmission of the sensor signal to any process controller the container may be operating with, such as any automated control and readout device desired, as are standard in the industry.

The containers of the present invention such as embodied by container 10 of FIG. 1 and container 100 of FIG. 2 are capable of being transported from the point of initial fill with liquid, high purity, high cost chemical, to warehousing to the ultimate utilization site and return for refurbishing and refill. However, it is also possible for these containers to be permanently sited in a chemical refill delivery system as is well known in the art or sited permanently or semi-permanently directly on the tool or chemical vapor deposition equipment which uses chemical from such containers to fabricate electronic devices, such as computer chips or integrated circuits. Such transportable containers, though offering ease of chemical use, do suffer from placement in sites or positioning that can frequently be at an angle from a precisely upright position, i.e., not sited on a precisely horizontal surface. Thus in the field of transportable high purity, high cost liquid chemical containers, the present invention offers distinct and surprising advantages in dispensing chemical to near completion, but without completely dispensing all chemical, so as to avoid a run dry condition, which can adversely effect downstream electronic device fabrication, especially in an automated process, such as the dispensing of chemical from these transportable containers.

Figures 3A, 3B, 3C:
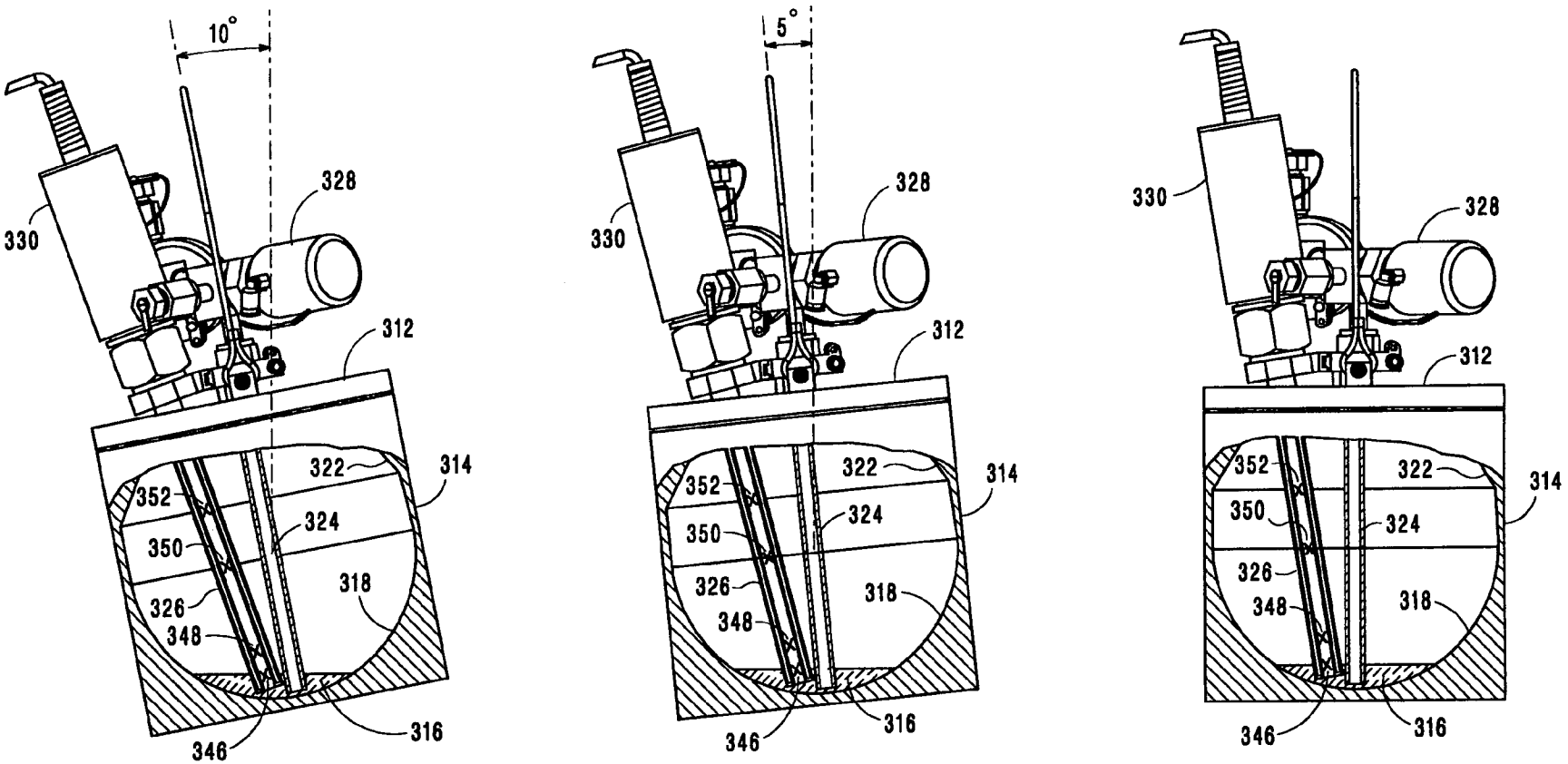
FIGS. 3A, B and C are schematic plan views of a 1.8 L container outfitted in accordance with one embodiment of the present invention in cross section showing liquid heals levels for 10° tilt from an upright container position; 5° tilt from an upright container position and 0° tilt or an upright container position.

FIGS. 3A, B and C illustrate the capability of the container 300 of the present invention to deliver consistent low level dispensing near complete dispensing of the contained liquid chemical, without running dry, at various angles from a precise upright position of the container, as would be experienced in actual use in the field (similar parts have similar part numbers for views A–C). FIG. 3C shows the container of the present invention in the most desired, but sometimes unachievable position of upright positioning on a horizontal support where the vertical axis of the container approximated by the diptube 324 is in a substantially vertical position in relation to the horizontal support upon which the container is placed. This position results in the lowest detectable level of residual chemical in the container being 2.25 cubic inches for the illustrated embodiment of a 1.8 liter container. The container is outfitted similar to the container of FIG. 1 wherein the container bottom wall has a hemi-spherical upward internal contour 318 connecting in a smooth curve to the side wall 314 defining a cylindrical shape, a top wall 312 which has a concave downward contour on its internal surface 322, an axially central diptube 324 terminating at the lowest most point of the bottom wall 316, a pneumatic valve 328 controlling the dispense of liquid chemical from the diptube, and a level sensor assembly 326 having a series of four discrete ultrasonic level sensors capable of signaling liquid levels at the lowest most sensor 346, a low level sensor 348, a middle level sensor 350 and a high level sensor 352, which all signal or communicate with a level signal process output 330.

FIG. 3B shows the same container, but with a position or attitude that is 5° off of a precise upright container position. Due to the hemi-spherical upward internal contour of the bottom wall and the positioning of both the diptube and the level sensor assembly proximate the lowest most point of the bottom wall, the residual content of the liquid chemical remains at the desirable minimum value of 2.25 cubic inches, comparable to the residual level or heals of the container position of FIG. 3C.

In FIG. 3A, the same result of minimal residual chemical content or heals is achieved even though the container position is angled further to 10° from a precise upright container position. Again, this surprising result is achieved because of the hemi-spherical upward contour of the bottom wall and the placement of the diptube and the level sensor assembly proximate one another adjacent the lowest most point of the bottom wall's internal surface.

These results, although illustrated for a hemi-spherical upward contour, are also achievable with other concave upward contours, such as hemi-ellipsoid, hemi-hyperboloid, hemi-elliptic paraboloid, and hemi-parabolic cylinder.

Figure 4:
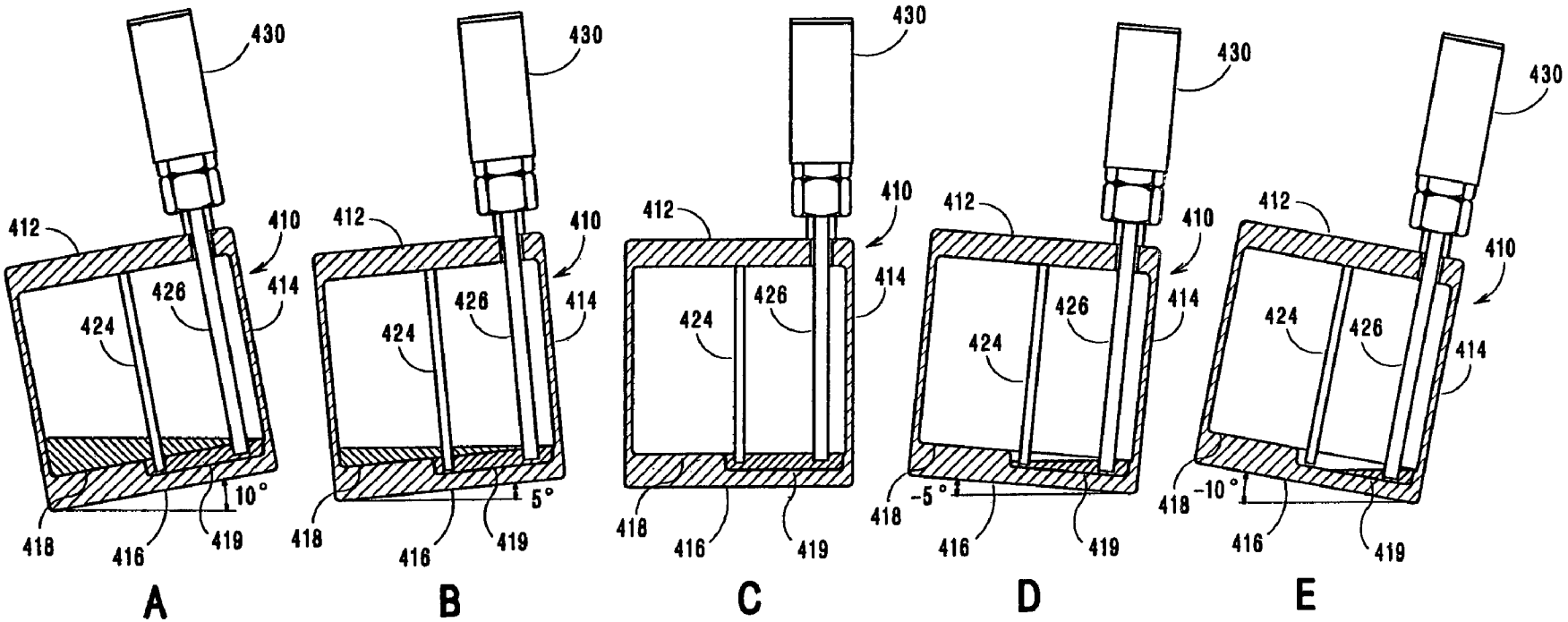
Fig. 4 Prior Art
FIGS. 4A, B, C, D and E are schematic plan views of a prior art container outfitted with an off-center sump in cross section showing liquid heals levels for 10° tilt from an upright container position opposite the sump; 5° tilt from an upright container position opposite the sump; 0° tilt or an upright container position; 5° tilt from an upright container position on the side of the sump; and 10° tilt from an upright container position on the side of the sump.

This insensitivity of the minimization of heals in the container despite container position variations is completely unexpected. Others in the industry attempting to minimize residual chemical or heals have resorted to various sumps in the container floor. For instance, FIG. 4 illustrates a prior art attempt in the industry to achieve minimal residual chemical content or heals in the container (similar parts have similar part numbers for views A–E). FIG. 4C shows such a container 410 ouffitted with a sump 419 in the bottom 416, below an internal floor 418 and having a diptube 424 and level sensor 426/controller 430 terminating in the sump 419. The container would typically have a top wall 412 and a sidewall 414. In FIG. 4C, the container is in a precisely upright position and the residual chemical content in the sump is calculated to be 2.5 cubic inches.

However, when the container assumes a position or attitude of a 5° angle towards the sump away from the precise upright position, FIG. 4D, the residual chemical or heals can be reduced to a calculated 1.6 cubic inches. This would appear to be desirable, but controlling such minimization can be difficult, because if the angle of the container's position is changed to 10° from the upright position, FIG. 4E, residual chemical drops to 1.2 cubic inches, but alarmingly, the level sensor still signals sufficient chemical for dispensing from the container, when in fact it can be seen that the diptube has become liquid dry or above the surface of the residual chemical, resulting in the worst circumstance for electronic device fabrication, i.e., processing of silicon wafers without the desired chemical due to the false reading of such a container with the expensive result of significant wafer defects and resulting drop in wafer yields; the worst case for electronic device fabricators.

Because the sump of this prior art container is not centrally located in the container floor, there exist other outcomes from positioning the container other than in a precise upright position. FIG. 4B shows the same prior art container having a 5° angle from upright away from the side of the container where the sump is located. In this instance, residual chemical or heals balloons to 8.42 cubic inches, severely aggravating the desire to minimize residual chemical or heals in the container when the level sensor signals the lowest most chemical level is achieved.

This result is only further aggravated when the container position is 10° angle from upright away from the side of the container where the sump is located, FIG. 4A. In this instance, residual chemical or heals further balloons to an unacceptable 19.13 cubic inches, again, severely aggravating the desire to minimize residual chemical or heals in the container when the level sensor signals the lowest most chemical level is achieved.

The reality in actual manufacturing in an electronic device fabrication facility is that although it would be presumed to be desirable to place a chemical container on a precisely horizontal surface or support, such placement cannot be assumed and there is a likelihood that such containers will be placed in positions at variance from a precise upright position or on a precisely horizontal surface or support. The container of the present invention achieves advantages and safety in minimizing residual chemical or heals without going liquid chemical dry over the prior art and in a distinct manner from the direction the prior art teaches, therefore constituting an unexpected and superior result over the prior art.

The present invention provides high purity containment, no chemical entrapment areas (i.e. sump, sidewall to bottom and top transition points) to harbor residual chemical during the container empty clean and refill procedure, a symmetrical design feature enabling cost effective manufacturing and polishing to the mirror finishes (10Ra) required for high purity chemical containers to maintain chemical purity, at the low and empty level sense points where the level precision is most important the smaller cross sectional area of the container concave upward section enables a more precise measurement of liquid and avoidance of contamination or particle generation during level sensing, and efficient chemical utilization approaching complete chemical utilization without reaching chemical run dry conditions.

Although the present invention has been illustrated and explained with regard to several particular embodiments, it is understood that other embodiments and variations are possible, such as additional inlets or outlets, valves that are operated by electrical solenoids, manual valves, hydraulic valves and the like. The features of this invention can be used on bulk chemical delivery containers, which refill downstream containers, direct delivery ampoules, both with vapor delivery, i.e., bubblers and direct liquid injection ("DLI").

The present invention has been set forth with regard to several preferred embodiments, however the full scope of the present invention should be ascertained by the claims, which follow.

The invention claimed is:

1. A transportable container for high purity, high cost, liquid chemical to maximize dispensing of the liquid chemical content of the container at deviations from an upright position without dispensing all of the liquid chemical, comprising;

a shell comprising a top wall, a side wall and a bottom wall, the bottom wall having an internal surface contacting liquid chemical with a smooth concave upward quadric contour having a lowest most point axially central to the container and forms a smooth curved surface with an internal surface of the side wall, a first orifice being used as an inlet, a second orifice being used as an outlet comprising a diptube through which the liquid chemical is dispensed from said container with an outlet end adjacent the top surface and an inlet terminal end adjacent the lowest most point, a level sensor assembly signaling at least one level of the liquid chemical in the container having an output end adjacent the top surface and a terminal end containing a lowest most level sensing sensor adjacent the lowest most point, wherein said level sensor assembly is selected from the group consisting of an ultrasonic level sensor assembly, a capacitance level sensor assembly, an optical level sensor assembly and a float level sensor assembly; the diptube and the level sensor assembly being more proximate to one another at their terminal ends than their ends adjacent the top surface.

2. The container of claim 1 wherein said orifice being used as an inlet and said orifice being used as an outlet each have a valve for controlling fluid flow through said orifices.

3. The container of claim 2 wherein said valves are pneumatic valves being operated by remote automated control.

4. The container of claim 1 wherein said sidewall has a cylindrical shape.

5. The container of claim 1 wherein said top wall has an internal surface with a concave downward contour.

6. The container of claim 1 wherein said concave downward contour is a quadric surface.

7. The container of claim 4 wherein said diptube is axially central to said sidewall.

8. The container of claim 1 wherein said level sensor assembly comprises two or more discrete level sensors.

9. The container of claim 8 wherein said level sensor assembly comprises three level sensors; a high level sensor adjacent the output end of the level sensor assembly; a low level sensor adjacent the terminal end of the level sensor assembly and a middle level sensor between the high level sensor and the low level sensor.

10. A transportable metallic container for high purity, high cost, liquid chemical to maximize dispensing of the liquid chemical content of the container at deviations from an upright position without dispensing all of the liquid chemical, comprising; a metallic shell comprising a top wall, a cylindrical side wall and a bottom wall, the bottom wall having an internal surface contacting liquid chemical with a smooth hemispherical upward contour having a lowest most point axially central to the container side wall and forms a smooth curved surface with an internal surface of the side wall, a first valved orifice being used as an inlet, a second valved orifice being used as an outlet comprising an axially central diptube through which the liquid chemical is dispensed from said container with an outlet end adjacent the top surface and an inlet terminal end adjacent the lowest most point, an ultrasonic level sensor assembly signaling at least three different levels of the liquid chemical in the container having an output end adjacent the top surface and a terminal end containing a lowest most level sensing sensor adjacent the lowest most point; the diptube and the level sensor assembly being more proximate to one another at their terminal ends than their ends adjacent the top surface.

11. The container of claim 10 wherein said top wall has a hemispherical downward contour.

12. The container of claim 10 wherein said level sensor assembly is positioned at an angle to the diptube with the terminal end of said assembly and said diptube being in close proximity to one another and the internal surface of said bottom wall at the axially central lowest most point of said hemispherically upward contour of said internal surface of said bottom wall.

13. A transportable container for high purity, high cost, liquid chemical to maximize dispensing of the liquid chemical content of the container at deviations from an upright position without dispensing all of the liquid chemical, comprising;

a shell comprising a top wall, a side wall and a bottom wall, the bottom wall having an internal surface contacting the liquid chemical with a smooth conical upward contour having a lowest most point axially central to the container and forms a smooth curved surface with an internal surface of the side wall, a first orifice being used as an inlet, a second orifice being used as an outlet comprising a diptube through which the liquid chemical is dispensed from said container with an outlet end adjacent the top surface and an inlet terminal end adjacent the lowest most point, a level sensor assembly signaling at least one level of the liquid chemical in the container having an output end adjacent the top surface and a terminal end containing a lowest most level sensing sensor adjacent the lowest most point, wherein said level sensor assembly is selected from the group consisting of an ultrasonic level sensor assembly, a capacitance level sensor assembly, an optical level sensor assembly and a float level sensor assembly; the diptube and the level sensor assembly being more proximate to one another at their terminal ends than their ends adjacent the top surface.

* * * * *